US007995949B2

(12) United States Patent
Shimizu

(10) Patent No.: US 7,995,949 B2
(45) Date of Patent: Aug. 9, 2011

(54) POWDER CONVEYANCE DEVICE, PROCESS UNIT, AND IMAGE FORMING DEVICE

(75) Inventor: Yoshiyuki Shimizu, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 537 days.

(21) Appl. No.: 12/103,941

(22) Filed: Apr. 16, 2008

(65) Prior Publication Data

US 2008/0279581 A1 Nov. 13, 2008

(30) Foreign Application Priority Data

May 7, 2007 (JP) ..... 2007-122702

(51) Int. Cl.
*G03G 21/16* (2006.01)

(52) U.S. Cl. ..... 399/111; 399/102; 399/119; 399/262; 399/258

(58) Field of Classification Search ..... 399/111, 399/119, 102, 262, 258, 359; 277/221
See application file for complete search history.

(56) References Cited

U.S. PATENT DOCUMENTS

| | | | | |
|---|---|---|---|---|
| 5,815,767 | A | 9/1998 | Kutsuwada et al. | |
| 5,934,680 | A * | 8/1999 | Kakehi et al. | 277/499 |
| 6,115,574 | A * | 9/2000 | Mikuriya | 399/258 |
| 6,546,219 | B2 | 4/2003 | Sato et al. | |
| 6,711,375 | B1 * | 3/2004 | Itoh | 399/359 |
| 6,977,022 | B2 | 12/2005 | Sato et al. | |
| 7,366,447 | B2 | 4/2008 | Mukai et al. | |
| 2001/0053298 | A1 * | 12/2001 | Fujishiro et al. | 399/159 |
| 2004/0253023 | A1 * | 12/2004 | Terazawa et al. | 399/262 |
| 2005/0226655 | A1 * | 10/2005 | Katsuyama et al. | 399/258 |
| 2006/0055120 | A1 * | 3/2006 | Umetsu et al. | 277/459 |
| 2006/0078361 | A1 * | 4/2006 | Park | 399/359 |
| 2006/0268373 | A1 | 11/2006 | Tatsumi et al. | |
| 2007/0104523 | A1 | 5/2007 | Yoshida et al. | |
| 2007/0140763 | A1 | 6/2007 | Shimizu et al. | |
| 2007/0248390 | A1 | 10/2007 | Kubota et al. | |

(Continued)

FOREIGN PATENT DOCUMENTS

JP 2-171791 7/1990

(Continued)

OTHER PUBLICATIONS

U.S. Appl. No. 11/870,104, filed Oct. 10, 2007, Yoshiyuki Shimizu et al.

*Primary Examiner* — David M Gray
*Assistant Examiner* — G. M. Hyder
(74) *Attorney, Agent, or Firm* — Oblon, Spivak, McClelland, Maier & Neustadt, L.L.P.

(57) ABSTRACT

A powder conveyance device is disclosed that enables plural powder conveyance paths to be easily and reliably attached and detached. The powder conveyance device includes a first housing including a first powder conveyance path, and a second housing including a second powder conveyance path, the first housing and the second housing being detachably attached to each other. A projection portion is provided in the first housing, the projection portion having a hole in communication with the first powder conveyance path, and a hole portion is provided in the second housing, the hole portion being in communication with the second powder conveyance path. When attaching the first housing to or detaching the first housing from the second housing, the projection portion is inserted into or drawn out of the hole portion.

16 Claims, 13 Drawing Sheets

U.S. PATENT DOCUMENTS

| | | | | |
|---|---|---|---|---|
| 2008/0019720 | A1 | 1/2008 | Kawakami et al. | |
| 2008/0145119 | A1 * | 6/2008 | Tatsumi et al. | 399/359 |

FOREIGN PATENT DOCUMENTS

| | | |
|---|---|---|
| JP | 08-202148 | 8/1996 |
| JP | 08-314221 | 11/1996 |
| JP | 09-185205 | 7/1997 |
| JP | 2000-112214 | 4/2000 |
| JP | 2001-296723 | 10/2001 |
| JP | 3281595 | 2/2002 |
| JP | 2003-36015 | 2/2003 |
| JP | 2004-264792 | 9/2004 |
| JP | 2005-10350 | 1/2005 |
| JP | 2006-18329 | 1/2006 |

* cited by examiner

[Name of the Document] Drawings (a)

(b)

POWDER CONVEYANCE DEVICE, PROCESS UNIT, AND IMAGE FORMING DEVICE

BACKGROUND OF THE INVENTION

1. Field of the Invention

The present invention relates to a powder conveyance device, a process unit using the powder conveyance device as a toner conveyance device, and an image forming device.

2. Description of the Related Art

In an image forming device, like a copier, a printer, a facsimile machine, or other multi-function peripherals (MFP), it is widely accepted to detachably attach a processing unit including processing means like image carriers, charging units, or toner containers to the image forming device, and as a result, it is possible to easily exchange the processing unit, and make maintenance easy.

In the related art, for example, Japanese Laid Open Patent Application No. 2-171791 (hereinafter, referred to as "reference 1") discloses a processing unit able to recover residual toner on an image carrier, and supply the toner to a developing unit. The processing unit includes an image carrier, a charging unit, a developing unit, a cleaning unit, a toner container, a toner conveyance path, and a toner conveyance unit, and these elements are arranged in a housing of the processing unit. After image formation operations, toner remaining on the image carrier is removed by the cleaning unit, and the thus obtained toner is conveyed to the toner conveyance path by the toner conveyance unit. The end of the toner conveyance path extends to the toner container, and the toner conveyed by the toner conveyance unit is collected in the toner container. Then, the toner is supplied to the developing unit from the toner container.

In the processing unit disclosed in reference 1, however, the constituent components, that is, the image carrier, the charging unit, the developing unit, the cleaning unit, the toner container, the toner conveyance path, and the toner conveyance unit are integrally arranged in the one housing of the processing unit. Hence, for example, when the service lifetime of even one component is finished, other components still within their service lifetimes have to be exchanged or disposed of together.

To solve this problem, in recent years, a structure of the processing unit has been required in which the constituent components of the processing unit are respectively arranged in plural housings, the housings being detachably attached to each other, and the housings are then attached.

With such a structure, when the service lifetime of one component is over, this unit can be separated from other units for exchange or disposal.

When the processing unit is adopted which has plural housings, usually, it is necessary to provide plural toner conveyance paths in the processing unit corresponding to the housings, and when attaching the housings, a structure is required in which the plural toner conveyance paths can be easily and reliably attached and detached.

SUMMARY OF THE INVENTION

The present invention may solve one or more problems of the related art.

A preferred embodiment of the present invention may provide a powder conveyance device enabling plural powder conveyance paths to be easily and reliably attached and detached, a process unit using the powder conveyance device, and an image forming device.

According to a first aspect of the present invention, there is provided a powder conveyance device, comprising:

a first housing including a first powder conveyance path therein; and a second housing including a second powder conveyance path therein, the first housing and the second housing being detachably attached to each other, wherein a projection portion is provided in the first housing, the projection portion having a hole in communication with the first powder conveyance path, a hole portion is provided in the second housing, the hole portion being in communication with the second powder conveyance path, when attaching the first housing to the second housing, the projection portion is inserted into the hole portion, and when detaching the first housing from the second housing, the projection portion is drawn out of the hole portion.

According to the present embodiment, when attaching the first housing to the second housing, the projection portion is inserted into the hole portion, and the first powder conveyance path and the second powder conveyance path are connected to each other.

Preferably, a sealing member is provided on an outer surface of the projection portion.

According to the present embodiment, since an outer surface of the projection portion and an inner surface of the hole portion are sealed by a sealing member, it is possible to prevent leakage of the powder on the powder conveyance paths of the housings to the outside, and prevent entrance of foreign matter from the outside to the powder conveyance paths.

Preferably, the sealing member is provided on the outer surface of the projection portion with an adhesive.

According to the present embodiment, since the sealing member is attached to the outer surface of the projection portion with an adhesive, it is possible to prevent the sealing member being separated from the outer surface of the projection portion.

Preferably, the thickness of the sealing member is greater than a gap between the outer surface of the projection portion and an inner surface of the hole portion.

According to the present embodiment, when the projection portion is inserted into the hole portion, the sealing member between the outer surface of the projection portion and the inner surface of the hole portion is compressed; thereby, it is possible for the sealing member to reliably seal the outer surface of the projection portion and the inner surface of the hole portion.

Preferably, a shape of an outer periphery of the projection portion is similar to a shape of an inner periphery of the hole portion.

According to the present embodiment, when the projection portion is inserted into the hole portion, compression of the sealing member in the redial direction becomes uniform over the circumferential direction. That is, the sealing member is not locally deformed by compression; hence, there is no space existing between the outer surface of the sealing member and the inner surface of the hole portion, and the sealing member can reliably seal the outer surface of the projection portion and the inner surface of the hole portion.

Preferably, the sealing member is formed from an elastic material.

According to the present embodiment, when inserting the projection portion into the hole portion, since the sealing member is formed of an elastic material, the sealing member can be compressively deformed, hence, the projection portion can be inserted into the hole portion smoothly. In addition, after the projection portion is inserted into the hole portion, because of the restoring force of the sealing member, the sealing member is in close contact with the inner surface of the hole portion; thus, the sealing member can reliably seal the outer surface of the projection portion and the inner surface of the hole portion.

Preferably, an inclined surface is formed on one or more of the outer surface of the projection portion, an outer surface of the sealing member, and an inner surface of the hole portion;

the inclined surface is inclined such that the size of the inclined surface decreases in an insertion direction in which the projection portion is inserted into the hole portion.

According to the present embodiment, because of existence of the inclined surface, when the projection portion can be inserted into the hole portion, it is easy to compressively deform the sealing member in the radial direction, and this makes it easy to insert the projection portion into the hole portion.

Preferably, the sealing member is strip-shaped, and is wound on the outer surface of the projection portion.

According to the present embodiment, it is easy to provide the sealing member on the outer surface of the projection portion.

Preferably, when the sealing member is wound on the outer surface of the projection portion, each of two opposite end surfaces of the sealing member includes:

a convex surface portion that projects to the other end surface;

a concave surface portion that faces a convex surface portion of the other end surface; and a connecting surface portion that connects the convex surface portion and the concave surface portion, and intersects a thickness direction of the sealing member, wherein the connecting surface portions of the two end surfaces are able to be brought into contact with each other.

According to the present embodiment, by bringing the connecting surface portions of the two end surfaces into contact, it is possible to prevent leakage of the powder from the two end surfaces of the sealing member. In addition, even when the connecting surface portions of the two end surfaces are not brought into contact, since the gap between the two end surfaces of the sealing member has a complicated shape, this is also helpful to prevent leakage of the powder from the two end surfaces of the sealing member.

Preferably, the length from the convex surface portion of one of the end surfaces of the sealing member to the concave surface portion of the other one of the end surfaces of the sealing member is less than a circumferential length of the projection portion.

According to the present embodiment, it is possible to closely wind the sealing member on the outer surface of the projection portion without local spaces existing between the sealing member and the outer surface of the projection portion. Hence, it is possible to prevent leakage of the powder from the space between the sealing member and the outer surface of the projection portion.

Preferably, a contacting portion is provided on the inner surface of the hole portion such that the contacting portion is in contact with a portion of the outer surface of the sealing member near the two opposite end surfaces of the sealing member.

According to the present embodiment, when the projection portion is inserted into the hole portion, the contacting portion of the hole portion is in contact with the portion of the outer surface of the sealing member near the two opposite end surfaces of the sealing member. Hence, it is possible to prevent leakage of the powder from the space near the two opposite end surfaces of the sealing member.

Preferably, the powder conveyance device further comprises:

a plurality of combinations of an insertion axle and an insertion hole able to be fitted to each other when the projection portion is inserted into the hole portion, wherein in each of the combinations, the insertion axle is provided on an inner side of one of the holes of the projection portion and the hole portion, and the insertion hole is provided on an inner side of the other one of the hole of the projection portion and the hole portion.

According to the present embodiment, when inserting the projection portion into the hole portion, it is easy to arrange the insertion axle and the insertion hole of each combination to be in correspondence with each other, and it is easy to insert each insertion axle into the corresponding insertion hole.

Preferably, when the projection portion is arranged to face the hole portion, intervals between the insertion axles and the corresponding insertion holes are different.

According to the present embodiment, it is possible to insert the insertion axles into the corresponding insertion holes sequentially in order of combinations. That is to say, since two or more of the insertion axles are not inserted into the corresponding insertion holes simultaneously, it is easy to insert each insertion axle into the corresponding insertion hole.

Preferably, one or more of the insertion axles are conveyance screws for powder conveyance, and the insertion holes corresponding to the one or more of the insertion axles are conveyance opening for powder conveyance.

According to the present embodiment, due to the conveyance screws, it is possible to smoothly convey the powder between the first housing and the second housing.

Preferably, the insertion axles and the insertion holes are connected by couplings.

According to the present embodiment, the insertion axles and the insertion holes can be connected without occupying a large space.

Preferably, an interference portion is provided that interferes with one of the insertion axles when the one of the insertion axles is inserted into one of the insertion holes other than the insertion hole corresponding to the one of the insertion axles.

According to the present embodiment, it is possible to prevent erroneous insertion of the insertion axles.

Preferably, the first housing and the second housing are attached so that the first housing and the second housing are able to be displaced relative to each other in a direction perpendicular to a direction of attaching the first housing and the second housing, and the sealing member is formed of a flexible material.

According to the present embodiment, when the first housing and the second housing are attached, even when the first housing and the second housing are displaced relative to each other in a direction perpendicular to the direction of attaching the first housing and the second housing, the sealing member between the projection portion and the hole portion is deformed accordingly in response to the relative displacement. Hence, the sealing member can not only seal the projection portion and the hole portion, but also provide a margin of the relative displacement between the first housing and the second housing.

According to a second aspect of the present invention, there is provided a processing unit able to detachably attached to a main body of an image forming device, comprising:

one or more of a charging unit, a developing unit, and a cleaning unit;

a toner container integrated with the one or more of the charging unit, the developing unit, and the cleaning unit; and a toner conveyance unit configured to convey toner, wherein the toner conveyance unit includes a first housing including a first toner conveyance path therein; and a second housing including a second toner conveyance path therein, the first housing and the second housing being detachably attached to each other, wherein a projection portion is provided in the first housing, the projection portion having a hole in communication with the first toner conveyance path, a hole portion is provided in the second housing, the hole portion being in communication with the second toner conveyance path, when attaching the first housing to the second housing, the projection portion is inserted into the hole portion, and when detaching the first housing from the second housing, the projection portion is drawn out of the hole portion.

Preferably, the processing unit further comprises:

an image carrier, wherein the image carrier, and the toner container are integrated with the one or more of the charging unit, the developing unit, and the cleaning unit.

According to a third aspect of the present invention, there is provided an image forming device, comprising:

a processing unit able to be detachably attached to a main body of the image forming device, said processing unit including one or more of a charging unit, a developing unit, and a cleaning unit; a toner container integrated with the one or more of the charging unit, the developing unit, and the cleaning unit; and a toner conveyance unit configured to convey toner, wherein the toner conveyance unit includes a first housing including a first toner conveyance path therein; and a second housing including a second toner conveyance path therein, the first housing and the second housing being detachably attached to each other, wherein a projection portion is provided in the first housing, the projection portion having a hole in communication with the first toner conveyance path, a hole portion is provided in the second housing, the hole portion being in communication with the second toner conveyance path, when attaching the first housing to the second housing, the projection portion is inserted into the hole portion, and when detaching the first housing from the second housing, the projection portion is drawn out of the hole portion.

According to the above embodiments of the present invention, when attaching the first housing and the second housing, it is possible to easily cause the powder conveyance paths in the housings to be in communication with each other, hence, it is possible to obtain a powder conveyance device superior in attachment performance.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

Figure 1:
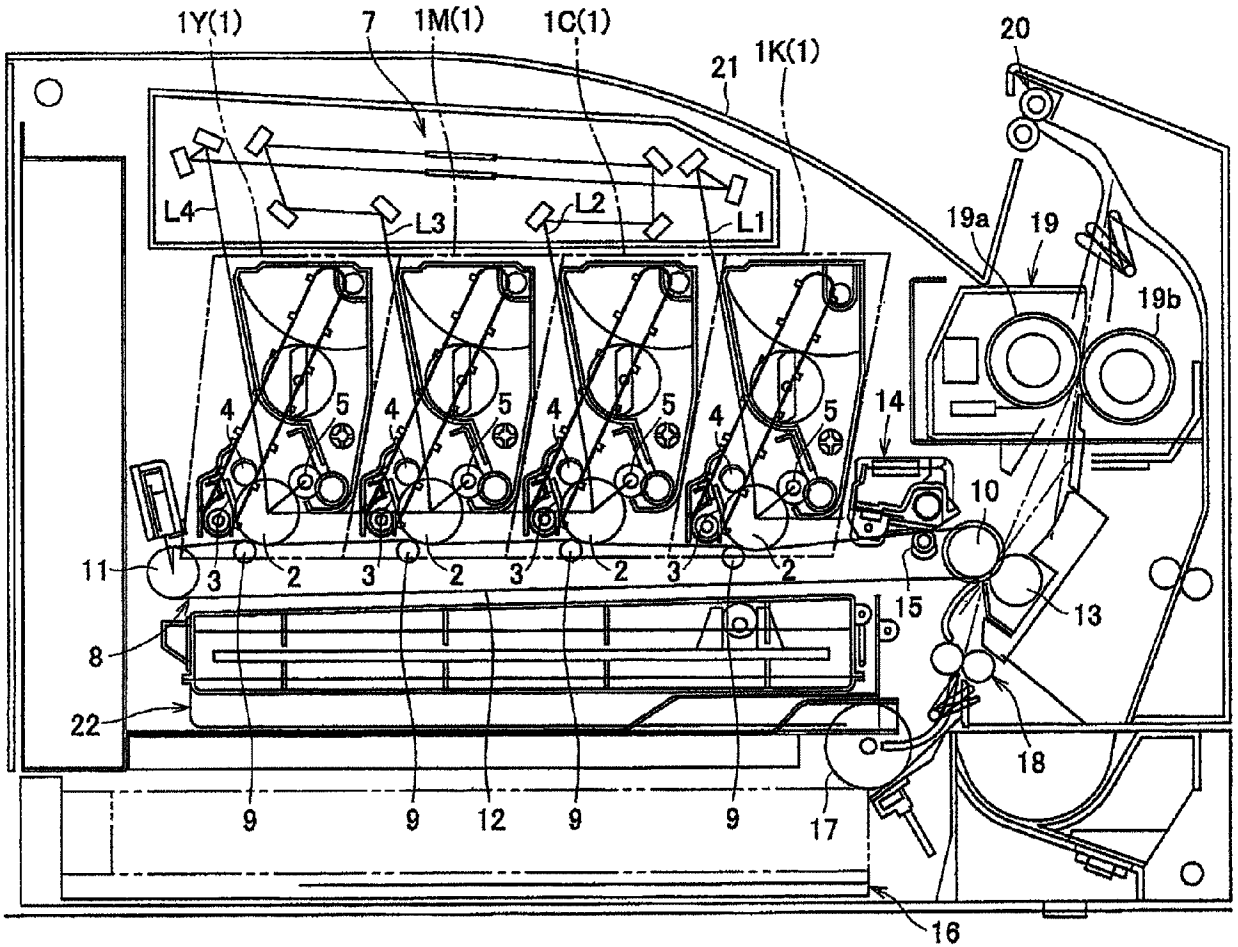
FIG. 1 is schematic cut-open view of an image forming device according to an embodiment of the present invention.

FIG. 1 is schematic cut-open view of an image forming device according to an embodiment of the present invention.

The image forming device as shown in FIG. 1 includes four processing units 1K, 1C, 1M, 1Y for forming images of black, cyan, magenta, and yellow colors, which are color components of a color image, by using black, cyan, magenta, and yellow developing agents, respectively.

The processing units 1K, 1C, 1M, 1Y have the same structure except that toners of different colors are carried in them.

Each of the processing units 1K, 1C, 1M, 1Y includes an image carrier 2, a cleaner 3, a charger 4, and a developer 5. Each of the processing units 1K, 1C, 1M, 1Y is detachably attached to the main body of the image forming device as shown in FIG. 1, and can be exchanged as a whole.

An exposure device 7 is arranged above the processing units 1K, 1C, 1M, 1Y. The exposure device 7 is configured to emit laser beams L1 through L4 from laser diodes according to input image data.

A transfer device 8 is arranged below the processing units 1K, 1C, 1M, 1Y. The transfer device 8 includes four primary transfer rollers 9 facing the image carriers 2, an intermediate transfer belt 12 rolling over the primary transfer rollers 9, a driving roller 10, and a driven roller 11, a secondary transfer roller 13 arranged to face the driving roller 10, a belt cleaning device 14 for removing residual toner on the intermediate transfer belt 12, and a cleaning backup roller 15.

In the lower portion of the image forming device shown in FIG. 1, there are a paper cassette 16 for accommodating many sheet-like recording media, like paper, and a paper feeding roller 17 for feeding out paper from the paper cassette 16. A pair of register rollers 18 for stopping the paper for a while is provided in the middle of the path from the paper feeding roller 17 to the nip between the driving roller 10 and the secondary transfer roller 13.

A fusing device 19 is provided above the nip between the driving roller 10 and the secondary transfer roller 13. The fusing device 19 includes a fusing roller 19*a* having a not-illustrated halogen lamp or other heat generators, and a pressuring roller 19*b* rotating while applying a specified pressure on the fusing roller 19*a*.

A pair of delivery rollers 20 for delivering paper to the outside is arranged above the fusing device 19. The papers delivered by the delivery rollers 20 are collected in a delivery tray 21, which is formed by a concavity in an upper cover.

A waste toner container 22 for re-collecting waste toner is provided between the transfer device 8 and the paper cassette 16, and a waste toner transferring hose extending from the belt cleaning device 14 is connected to an entrance of the waste toner container 22.

Below, configurations of the processing units 1K, 1C, 1M, 1Y are explained. In the following descriptions, one of the processing units 1K, 1C, 1M, 1Y is used as an example, and is simply indicated by a reference numeral "1".

Figure 2:
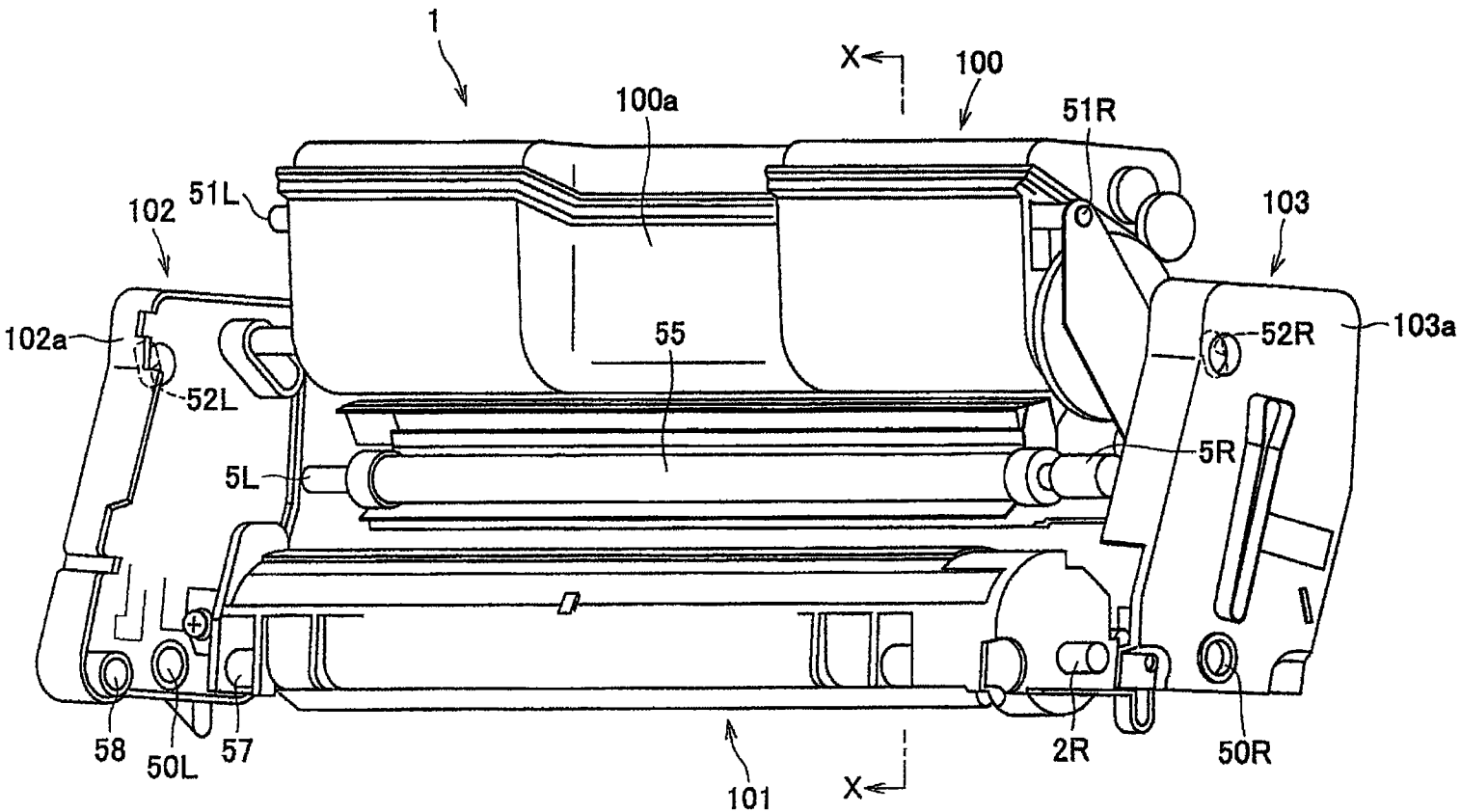
FIG. 2 is an exploded perspective view of the processing unit 1.

FIG. 2 is an exploded perspective view of the processing unit 1.

As shown in FIG. 2, the processing unit 1 includes a developing unit 100, an image carrying unit 101, a left-side supporting member 102 and a right-side supporting member 103 for supporting the developing unit 100 and the image carrying unit 101.

Bearings 50R and 50L are provided on housings 102*a*, 103*a* of the left-side supporting member 102 and the right-side supporting member 103 to support two ends 2R, 2L of the rotating axle of the image carrier 2 included in the image carrying unit 101. Note that in FIG. 2, only the right end 2R is illustrated.

In addition, bosses 51R and 51L are provided above two side surfaces of the developing unit 100, and slide engagement portions 52R, 52L for supporting the bosses 51R and 51L are on the left-side supporting member 102 and the right-side supporting member 103. The slide engagement portions 52R, 52L are shaped to be holes elongated in the vertical direction; by engagement of the slide engagement portions 52R, 52L and the bosses 51R and 51L, the developing unit 100 is slidably supported by the left-side supporting member 102 and the right-side supporting member 103.

Figure 4:
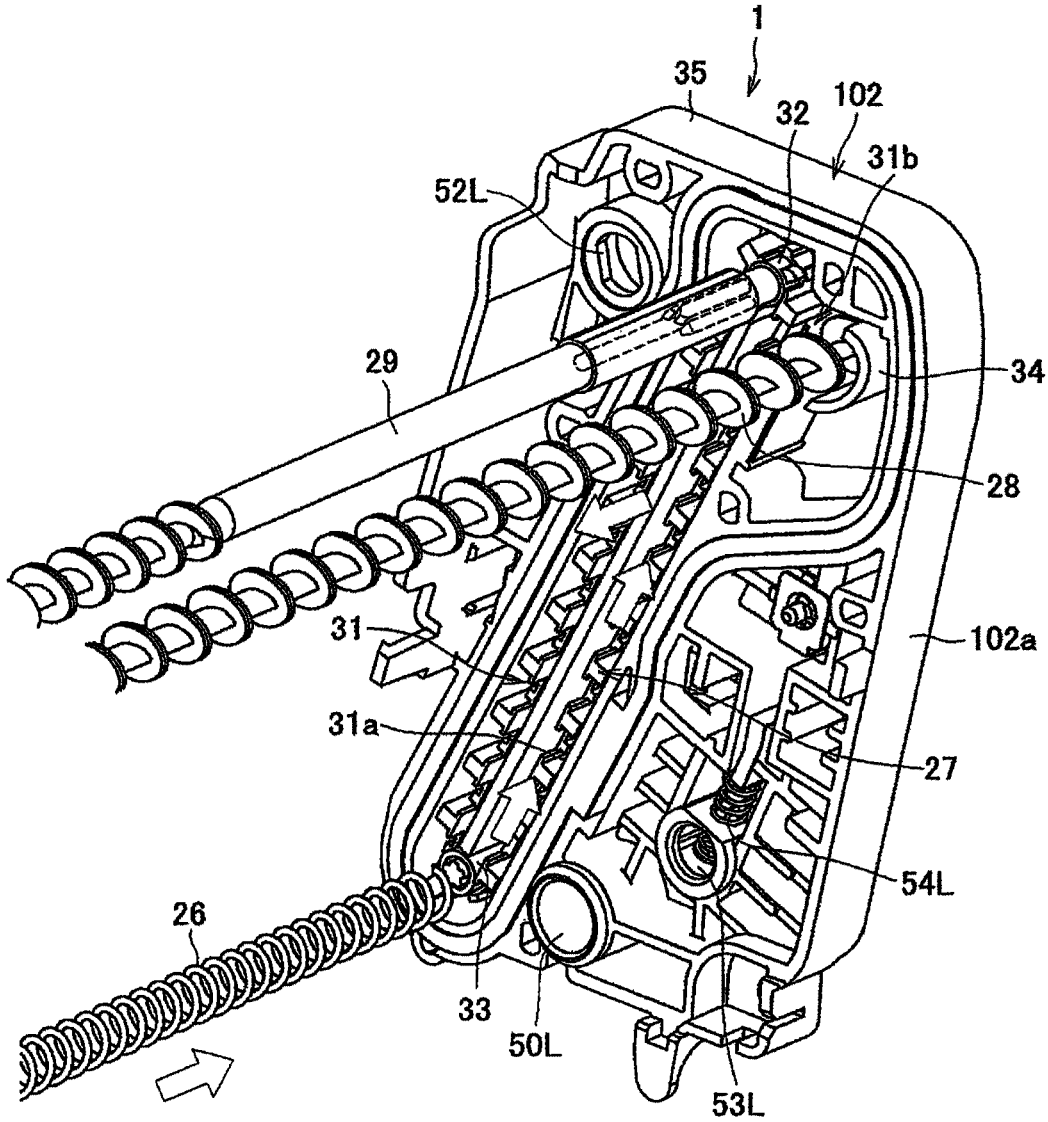
FIG. 4 is a perspective view of a part of the processing unit 1 exposing the interior portion of the housing 102*a* of the left-side supporting member 102.

In addition, bearings 53R, 53L (refer to FIG. 4) are provided on the housings 102*a*, 103*a* of the left-side supporting member 102 and the right-side supporting member 103 to support two ends 5R, 5L of the rotating axle of a developing roller 55 of the developing unit 100. Note that in FIG. 4, only the left bearing 53L is illustrated. The bearings 53R, 53L are pushed by springs 54R, 54L, respectively. In FIG. 4, only the left spring 54L is illustrated.

Due to the sliding of the bosses 51R and 51L relative to the slide engagement portions 52R, 52L and the elastic potential energy of the deformed springs 54R, 54L, the developing roller 55 can be pressed against the image carrier 2 while being able to slightly swing. In addition, for example, by stuffing a wedge or other objects between the side of the bearing 53L pressed by the spring 54L and the opposite side of the bearing 53L, the developing roller 55 can be forcefully separated from the image carrier 2. In doing so, it is possible to present elastic deformation caused by pressured contact between the developing roller 55 and the image carrier 2, for example, during shipment.

Figure 3:
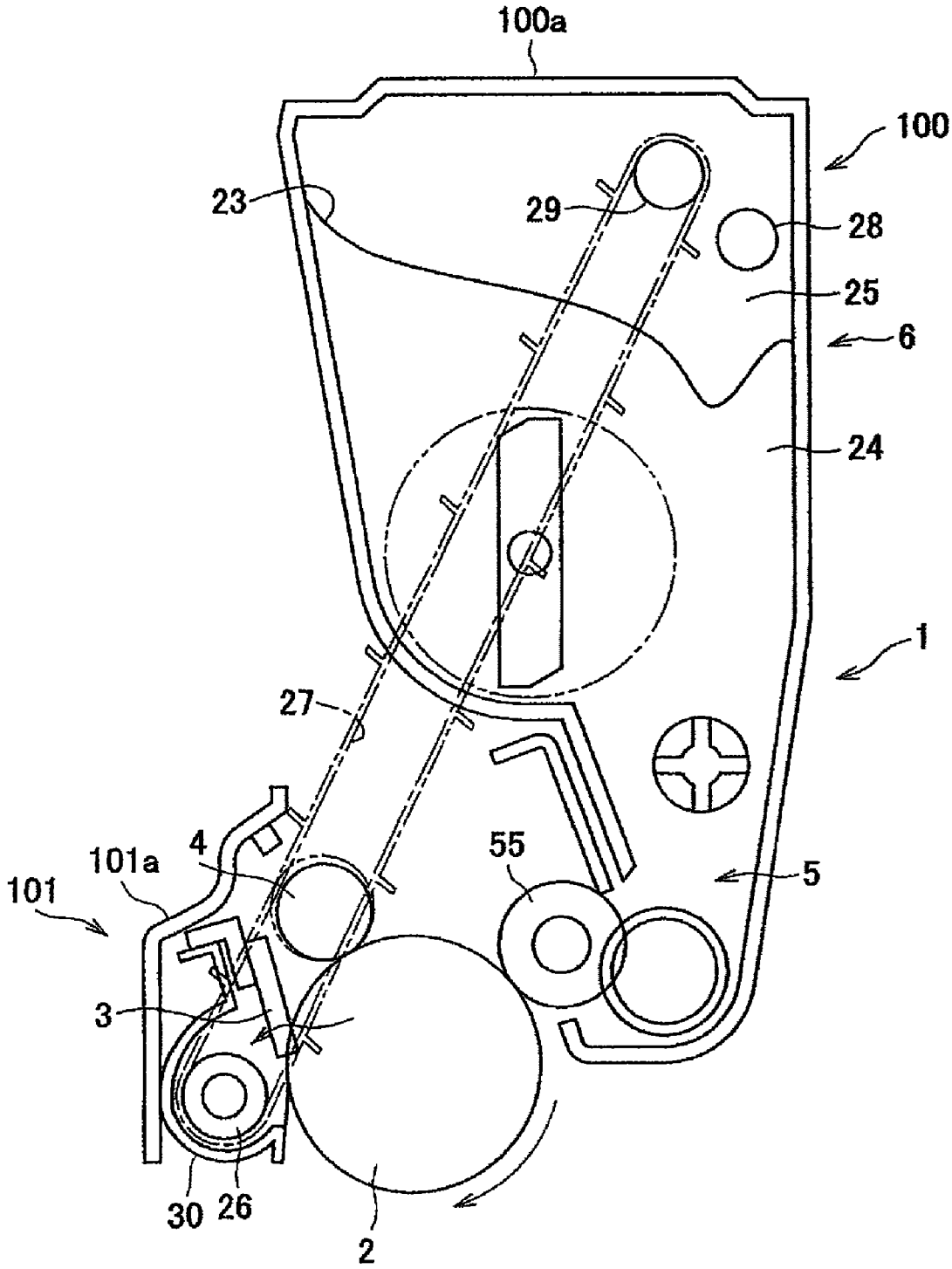
FIG. 3 is a cross-sectional view of the processing unit 1 along the X-X line in FIG. 2.

FIG. 3 is a cross-sectional view of the processing unit 1 along the X-X line in FIG. 2.

As shown in FIG. 3, the developing roller 55 of the developer 5 is provided below a housing 100*a* of the developing unit 100, and a toner container 6 is disposed inside the housing 100*a*. The toner container 6 includes an unused toner section 24 filled with toner of different colors, and a waste toner section 25 for re-collecting waste toner; the unused toner section 24 and the waste toner section 25 are partitioned by a flexible partitioning member 23.

For example, the partitioning member 23 is a sheet-like member made of plastic, and is movable toward either the unused toner section 24 or the waste toner section 25. For example, while toner in the unused toner section 24 is being consumed and the amount of toner in the unused toner section 24 decreases continuously, more and more waste toner is being re-collected in the waste toner section 25, and because of the weight of the re-collected waste toner, the partitioning member 23 is pushed to move gradually to the side of the unused toner section 24.

Inside the waste toner section 25, there are a conveyance screw 28 for conveying the waste toner from the outside, and a stirring screw 29 for stirring the waste toner in the waste toner section 25 during conveyance. In other words, the waste toner section 25 constitutes a toner conveyance path for conveying the waste toner by the conveyance screw 28 and the stirring screw 29, and also functions as storage space for storing the conveyed waste toner.

The image carrier 2, the cleaner 3, and the charger 4 are provided on a housing 101*a* of the image carrying unit 101. A toner receiving section 30 is provided below the cleaner 3 to extend in the horizontal direction for receiving waste toner, and a conveyance coil 26 is rotably held in the toner receiving section 30. The toner receiving section 30 serves as a powder conveyance path for conveying toner in the horizontal direction by the conveyance coil 26.

FIG. 4 is a perspective view of a part of the processing unit 1 exposing the interior portion of the housing 102*a* of the left-side supporting member 102.

As shown in FIG. 4, an annular groove 31 serving as a powder conveyance path is formed in the housing 102*a* of the left-side supporting member 102, and a conveyance belt 27 circularly runs along the annular groove 31. The conveyance belt 27 is a seamless belt with plural projection and depression portions are formed on an outer surface, serving as a conveyance surface of the conveyance belt 27, and the waste toner is held and conveyed between the projection and depression portions of the conveyance belt 27 and a circumferential wall 31*a*, which constitutes the annular groove 31. In addition, a cut-out 31*b* is formed in the upper portion of the wall 31*a* of the annular groove 31, and a toner receiving section 26 is provided below the cut-out 31*b*.

The conveyance belt 27 is suspended on a driving force transmitting axle 32 on the upper side (serving as driving means) and a roller bearing 33 on the lower side. Note that although here it is assumed that the conveyance belt 27 is suspended on two axles, the present embodiment is not limited to this. For example, the conveyance belt 27 may also be suspended on three or more axles.

Below, basic operations of the image forming device according to the current embodiment are described.

In FIG. 1, the paper feeding roller 17 starts to rotate in response to a paper-feeding signal from a not-illustrated controller of the image forming device. Upon that, only the piece of paper on the top of the paper stack held in the paper cassette 16 is separated, and is fed out to the pair of register rollers 18. When the front end of the paper arrives at the nip of the pair of register rollers 18, the paper is stopped for a while, with slackness formed thereon, for synchronization (timing agreement) with the toner image formed on the intermediate transfer belt 12.

Image formation operations in the image forming device according to the current embodiment are described. In the following, the processing unit 1K is used as an example for descriptions.

First, the charger 4 charges the surface of the image carrier 2 to a high electrical potential. The exposure device 7 emits a laser beam L1 to the surface of the image carrier 2 according to input image data, the exposed portion of the surface of the image carrier 2 decreases in electrical potential, and a latent image is formed. The developer 5 transfers toner to the portion of the surface of the image carrier 2 with the latent image to form a black toner image (visible image). Similarly, in the other processing units 1C, 1M, 1Y, respective cyan, magenta, and yellow toner images are formed, and the toner images of four colors are transferred to the intermediate transfer belt 12 and are superposed there.

The paper feeding roller 17 and the pair of register rollers 18 are re-driven, and paper is sent to the secondary transfer roller 13 in synchronization with (timing agreement) the toner image transferred and superposed on the intermediate transfer belt 12. Then, the secondary transfer roller 13 transfers the toner image superposed on the intermediate transfer belt 12 onto the paper.

The paper with the toner image thereon is conveyed to the fusing device 19, and is sandwiched by the fusing roller 19*a* and the pressuring roller 19*b*; the toner image is heated and pressed so as to be fused on the paper. The paper with the toner image fused thereon is sent from the fusing device 19 to the pair of delivery rollers 20, and delivered from the fusing device 19 to the delivery tray 21.

After the toner image on the intermediate transfer belt 12 is transferred onto the paper, residual toner adheres to the intermediate transfer belt 12. The residual toner is removed from the intermediate transfer belt 12 by the belt cleaning device 14. The toner removed from the intermediate transfer belt 12 is conveyed by not-illustrated waste toner conveyance means to the waste toner container 22 for re-collection.

In addition, each of the cleaners 3 removes residual toner adhering to the surface of the corresponding image carrier 2 after the intermediate transfer. Then, a not-illustrated neutralization device is used to remove remaining charges on the image carrier 2 after the cleaning.

The toner removed by the cleaner 3 is received by the toner receiving section 30 (refer to FIG. 3). The waste toner is conveyed to the lower part of the annular groove 31 (refer to FIG. 4) by the conveyance coil 26 rotating in the toner receiving section 30, and is conveyed to the upper part in the annular groove 31 by the conveyance belt 27. The waste toner conveyed by the conveyance belt 27 falls into the cutout 31*b* in the upper part of the annular groove 31, and is received by a toner receiving part 34. Then, the waste toner received by the toner receiving part 34 is transported, by the rotation of the conveyance screw 28, from a hole portion 45 (refer to FIG. 9) for introducing toner into the waste toner section 25.

Spiral portions of the conveyance screw 28 and the stirring screw 29 are formed to have the same orientation, but rotate in reverse relative to each other. That is, the conveyance screw 28 transports the waste toner to the inside far from the hole portion 45 of the waste toner section 25 (refer to FIG. 9), whereas the stirring screw 29 transfers the waste toner transported by the conveyance screw 28 to the near side close to the hole portion 45 of the waste toner section 25. As the conveyance screw 28 and the stirring screw 29 transfer the waste toner in opposite directions relative to each other, it is possible for the partition member 23, which is elastically deformable, to efficiently expand downward to accommodate the waste toner.

Figure 5:
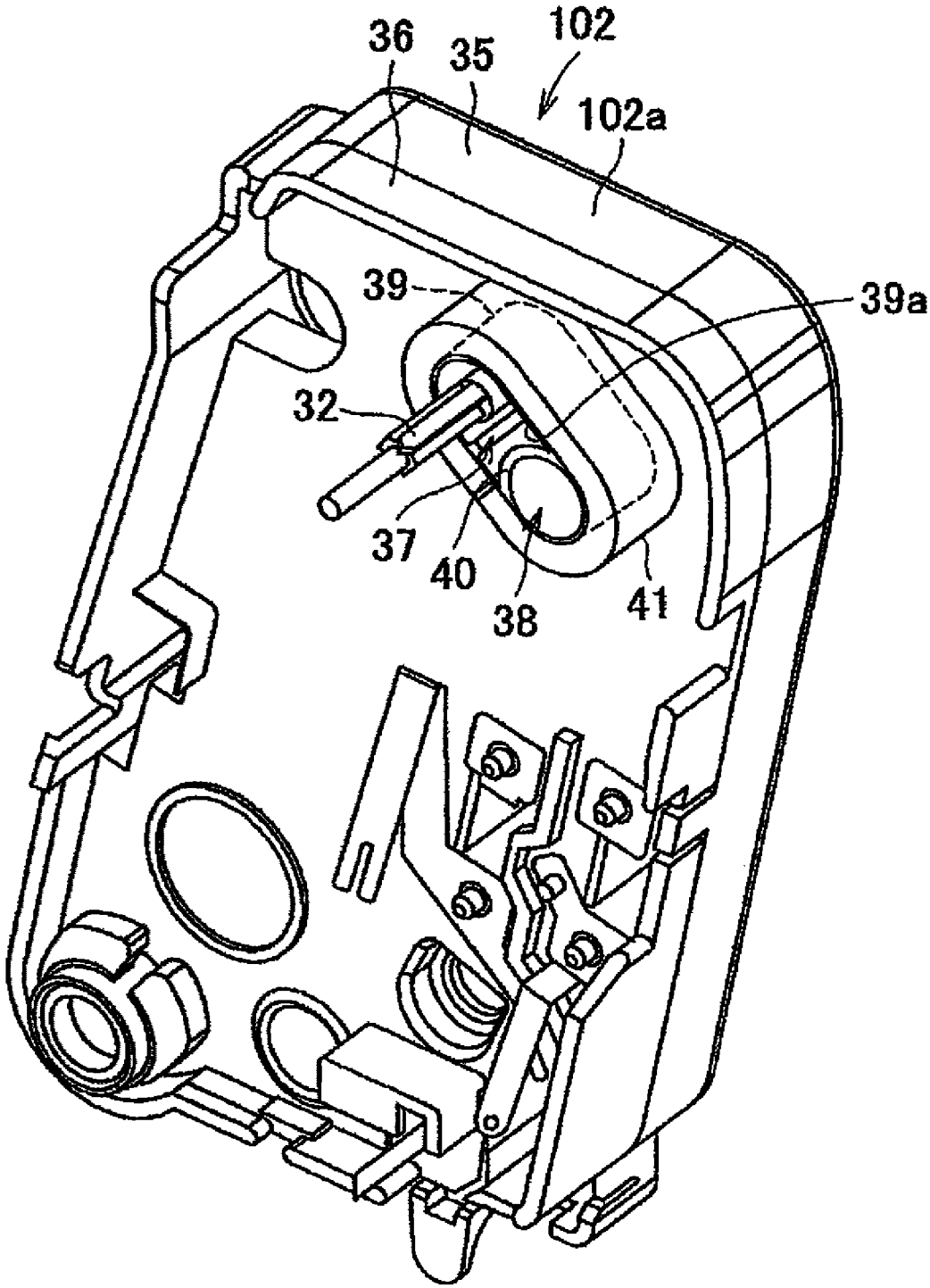
FIG. 5 is a perspective view of the left-side supporting member 102.

FIG. 5 is a perspective view of the left-side supporting member 102.

As shown in FIG. 5, in the housing 102*a* of the left-side supporting member 102, there are a case 35 which forms the annular groove 31 (refer to FIG. 4), and a cover member 36 which is joined to the case 35. A projection part 39 having an elongated hole 39*a* is provided on the outer surface of the cover member 36. In the elongated hole 39*a* of the projection part 39, a penetration hole 37 for the driving force transmitting axle 32 to project outward and a conveyance opening 38 for conveying the waste toner are arranged adjacent to each other. In addition, a partition wall 40 of an arc shape is provided in the elongated hole 39*a* of the projection part 39 to partition the interior space of the projection part 39 into the penetration hole 37 and the conveyance opening 38. Further, the conveyance opening 38 is in communication with the toner receiving part 34.

A sealing member 41 is provided on the outer surface of the projection part 39.

Figure 6:
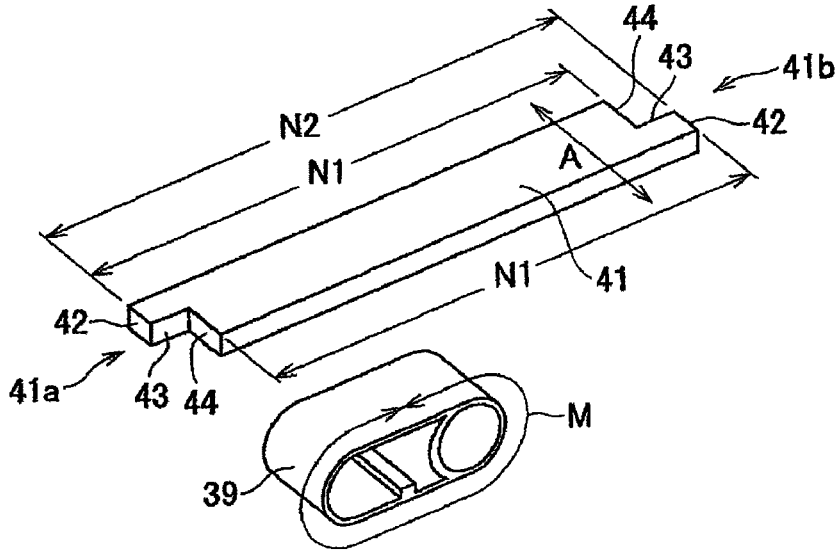
FIG. 6 is a perspective view illustrating the projection part 39 prior to attachment of the sealing member 41.

FIG. 6 is a perspective view illustrating the projection part 39 prior to attachment of the sealing member 41.

Figure 7:
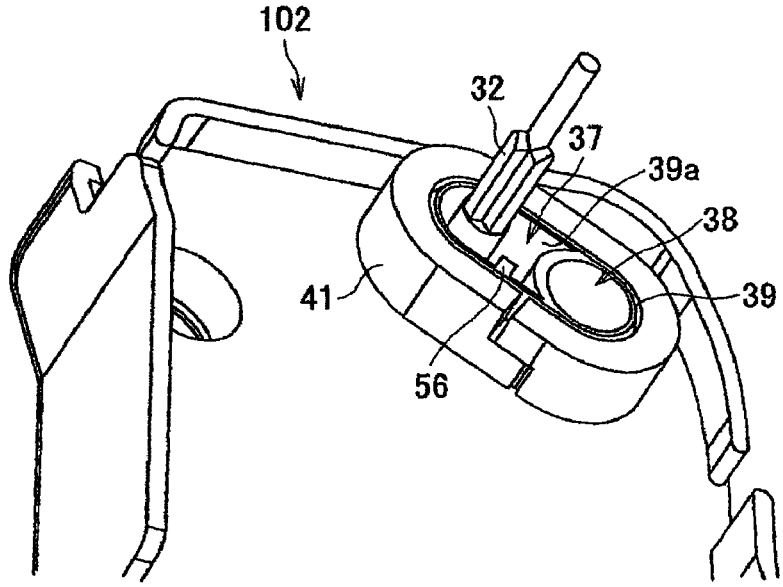
FIG. 7 is a perspective view illustrating the condition in which the sealing member 41 is wound on the outer surface of the projection part 39.

As shown in FIG. 6, the sealing member 41 is strip-like, and the sealing member 41 is wound on the outer surface of the projection part 39 (refer to FIG. 7). It is preferable that the sealing member 41 be attached to the projection part 39 by double-face adhesive tape or other adhesive agents. Further, concerning materials of the sealing member 41, for example, it is preferable that the sealing member 41 be formed from PUR (polyurethane), rubber, or any elastic member or flexibility member having appropriate elasticity or flexibility.

The end surfaces 41*a*, 41*b* of the sealing member 41 include convex surfaces 42, concave surfaces 44, and connecting surfaces 43 for connecting the convex surfaces 42 and the concave surfaces 44. The connecting surfaces 43 intersect the thickness direction A of the sealing member 41. In FIG. 6, it is illustrated that the connecting surfaces 43 intersect the thickness direction A of the sealing member 41 essentially at a right angle, and opposite to the convex surface 42 of one end surface 41*a*, the concave surface 44 is arranged on the other end surface 41*b*, and opposite to the concave surface 44 of one end surface 41*a*, the convex surface 42 is arranged on the other end surface 41*b*.

The length N1 from the convex surface 42 on one end surface to the concave surface 44 on the opposite end surface is more or less shorter than the circumferential length of the projection part 39. Therefore, when winding the sealing member 41 on the outer surface of the projection part 39, as shown in FIG. 7 and FIG. 8, there are intervals S between the concave surfaces 44 and the convex surfaces 42.

FIG. 7 is a perspective view illustrating the condition in which the sealing member 41 is wound on the outer surface of the projection part 39.

Figure 8:
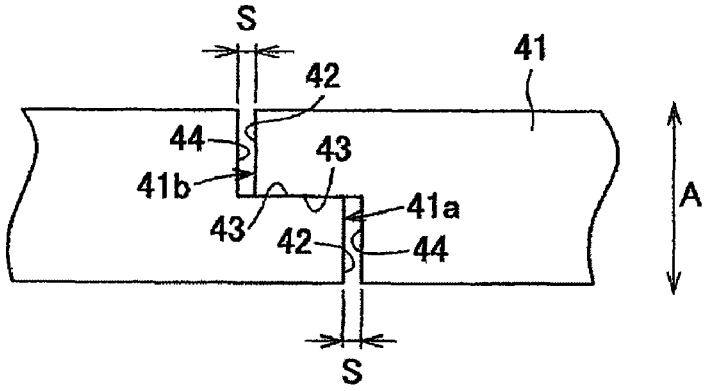
FIG. 8 is an enlarged plan view illustrating principal portions of the sealing member 41.

FIG. 8 is an enlarged plan view illustrating principal portions of the sealing member 41.

Because of the existence of the clearances S, it is possible to closely wind the sealing member 41 on the outer surface of the projection part 39 without local spaces existing between the sealing member 41 and the outer surface of the projection part 39.

The length N2 from the convex surface 42 on one end surface to the concave surface 44 on the opposite end surface more or less longer than the circumferential length of the projection part 39. Therefore, when winding the sealing member 41 on the outer surface of the projection part 39, the connecting surfaces 43 of the two end surfaces 41*a*, 41*b* can be brought into contact with each other (refer to FIG. 8). For example, the connecting surfaces 43 can be connected by double-face adhesive tape or other adhesive agents.

In addition, the sealing member 41 can be shaped to have a width less than that in FIG. 6, or the sealing member 41 can be shaped to be a string, and wound on the outer surface of the projection part 39 with multiple turns, or instead of the strip-like shape, the sealing member 41 can be of a loop shape to fit on the outer surface of the projection part 39, or any other shape. In addition, on each of the end surfaces 41*a*, 41*b* of the sealing member 41, multiple convex surfaces 42, concave surfaces 44, and connecting surfaces 43 may be formed in the thickness direction A.

Figure 9:
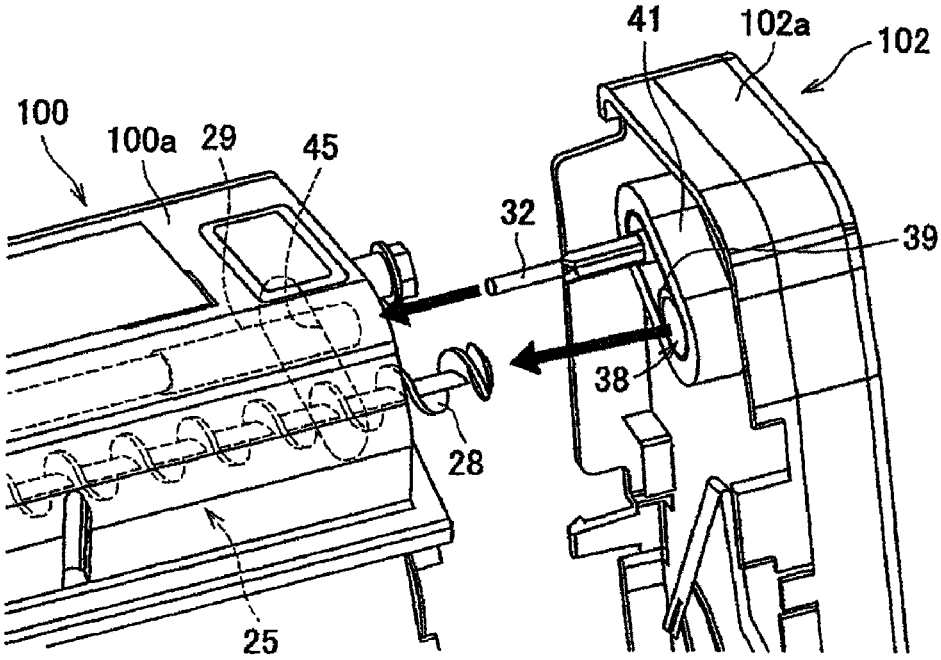
FIG. 9 is a perspective view illustrating assembling of the left-side supporting member 102 and the developing unit 100 of the processing unit 1.

FIG. 9 is a perspective view illustrating assembling of the left-side supporting member 102 and the developing unit 100 of the processing unit 1.

As shown in FIG. 9, on the side surface of the developing unit 100 facing the left-side supporting member 102, the hole part 45 is formed which allows the projection part 39 wound by the sealing member 41 to be inserted into the hole part 45. The hole part 45 is in communication with the waste toner section 25 in the developing unit 100, and the ends of the conveyance screw 28 and the stirring screw 29 project from the hole part 45.

The end of the stirring screw 29 projecting from the hole part 45 can be connected to the driving force transmitting axle 32, and the other end of the stirring screw 29 (not illustrated), that is, the end opposite to the driving force transmitting axle 32 is connected to a driving gear, and the rotational motion of the driving gear is transmitted to the conveyance belt 27 through the stirring screw 29 and the driving force transmitting axle 32 (refer to FIG. 4).

The stirring screw 29 and the driving force transmitting axle 32 are connected by a coupling.

Figure 10:
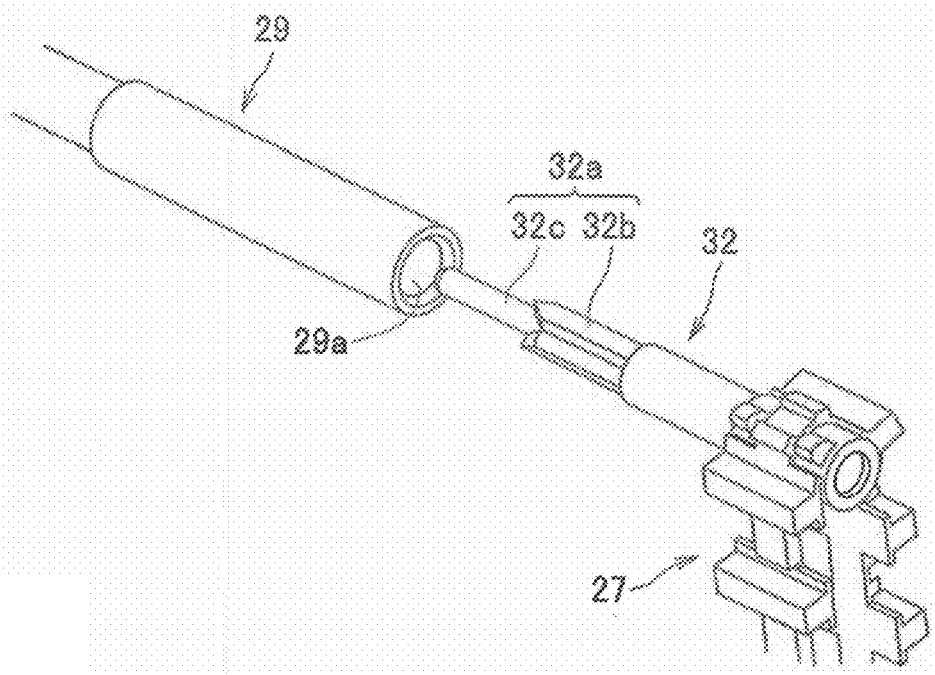
FIG. 10 is a perspective view illustrating a principal portion of the left-side supporting member 102 and the developing unit 100 of the processing unit 1 to show a connection mechanism of the stirring screw 29 and the driving force transmitting axle 32.

FIG. 10 is a perspective view illustrating a principal portion of the left-side supporting member 102 and the developing unit 100 of the processing unit 1 to show a connection mechanism of the stirring screw 29 and the driving force transmitting axle 32.

As shown in FIG. 10, the driving force transmitting axle 32 has an insertion axle 32*a* extending to the stirring screw 29. On the insertion axle 32*a*, there are provided a projecting engagement part 32*b*, which includes multiple projections distributing over the circumferential direction with each projection extending in the axial direction, a guide part 32*c* which looks like a pin and extends in the axial direction from the end of the projecting engagement part 32*b*. On the other hand, an insertion hole 29*a* for inserting the insertion axle 32*a* of the driving force transmitting axle 32 is formed on the end of the stirring screw 29 on the side of the driving force transmitting axle 32, and a receiving engagement part (not illustrated) for engaging the projecting engagement part 32*b* of the insertion axle 32*a* is formed inside the insertion hole 29*a*.

The end of the conveyance screw 28, which projects from the hole portion 45 to the outside, passes through the conveyance opening 38 and is positioned in the toner receiving part 34 in the left-side supporting member 102 (refer to FIG. 4). That is, if the conveyance screw 28 is an insertion axle, the conveyance opening 38 becomes an insertion hole, and the conveyance screw 28 can be inserted into or drawn out from the conveyance opening 38. In addition, in order that the conveyance screw 28 is not erroneously inserted into the penetration hole 37 adjacent to the conveyance opening 38, as shown in FIG. 7, an interference portion 56 is provided on the inner surface of the penetration hole 37, and when the conveyance screw 28 is started to be erroneously inserted into the penetration hole 37, the end of the conveyance screw 28 touches the interference portion 56, thereby preventing the conveyance screw 28 from being erroneously inserted into the penetration hole 37.

Figure 11:
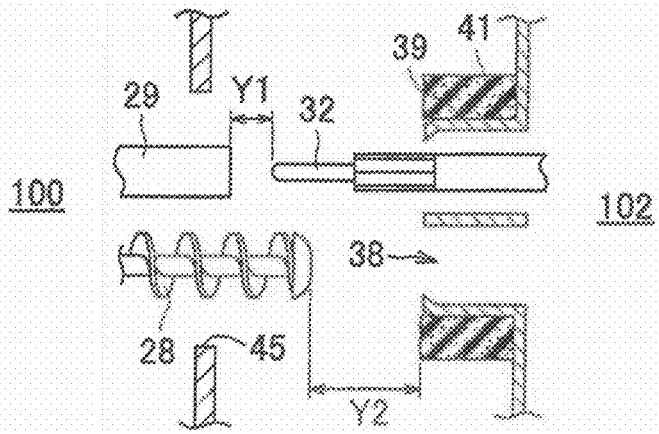
FIG. 11 is a cross-sectional view illustrating a principal portion of the left-side supporting member 102 and the developing unit 100 of the processing unit 1 as shown in FIG. 9.

FIG. 11 is a cross-sectional view illustrating a principal portion of the left-side supporting member 102 and the developing unit 100 of the processing unit 1 as shown in FIG. 9.

As shown in FIG. 11, when the projection part 39 is brought to face the hole part 45, the size Y1 of the gap between the driving force transmitting axle 32 and the stirring screw 29 (precisely, the insertion hole 29*a* of the stirring screw 29) is less than the size Y2 of the gap between the conveyance opening 38 and the conveyance screw 28. It should be noted that this relationship of the size of the two gaps can be reversed, that is, the size Y1 of the gap between the driving force transmitting axle 32 and the stirring screw 29 can be greater than the size Y2 of the gap between the conveyance opening 38 and the conveyance screw 28.

Figure 12:
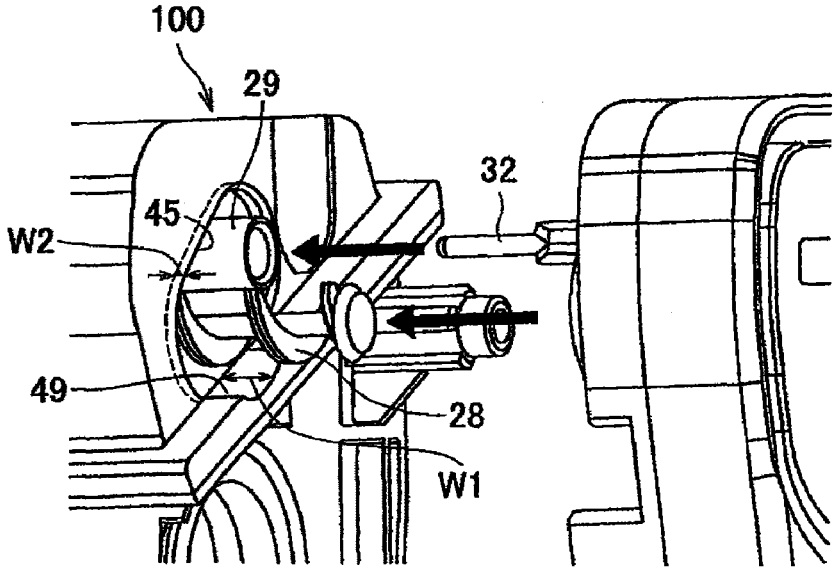
FIG. 12 is a perspective view illustrating a principal portion of the left-side supporting member 102 and the developing unit 100 of the processing unit 1 as shown in FIG. 9 but viewed from an angle different from that in FIG. 9.

FIG. 12 is a perspective view illustrating a principal portion of the left-side supporting member 102 and the developing unit 100 of the processing unit 1 as shown in FIG. 9 but viewed from an angle different from that in FIG. 9.

As shown in FIG. 12, a contacting part 49 is provided at a lower position on the inner surface of the hole part 45. The width W1 of the contacting part 49 is greater than the width of the other portion of the inner surface of the hole part 45. In addition, when winding the sealing member 41 on the outer surface of the projection part 39, the end surfaces 41*a*, 41*b* of the sealing member 41 are brought to face each other below the projection part 39. With the sealing member 41 wound on the outer surface of the projection part 39 in this way, when the projection part 39 is brought to face the hole part 45, the end surfaces 41*a*, 41*b* of the sealing member 41 are arranged to correspond to the contacting part 49.

Figure 13:
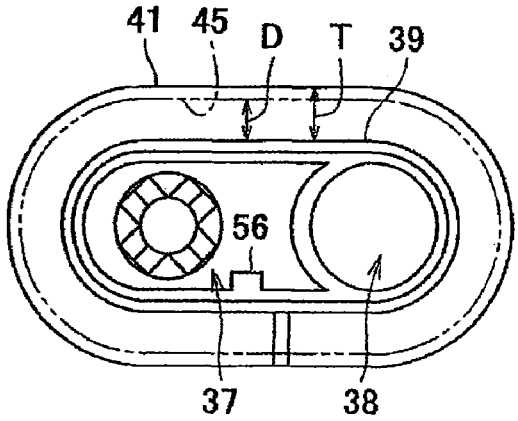
FIG. 13 is a plan view of the projection part 39 and the hole part 45 for comparing the size of the gap between the projection part 39 and the hole part 45 with the thickness of the sealing member 41.

FIG. 13 is a plan view of the projection part 39 and the hole part 45 for comparing the size of the gap between the projection part 39 and the hole part 45 with the thickness of the sealing member 41.

In FIG. 13, the projection part 39 is wound by the sealing member 41, and is at a position corresponding to the hole part 45. As shown in FIG. 13, the shape of the outer periphery of the projection part 39 is similar to the shape of the inner periphery of the hole part 45, and there is a gap D between the outer surface of the projection part 39 and the inner surface of the hole part 45. Further, the thickness T of the sealing member 41 is greater than the gap D between the outer surface of the projection part 39 and the inner surface of the hole part 45; thereby, when the projection part 39 is inserted into the hole part 45, the sealing member 41 is compressed the outer surface of the projection part 39 and the inner surface of the hole part 45.

In the following, the direction in which the projection part 39 is inserted into the hole part 45 is referred to as "insertion direction".

Figure 14:
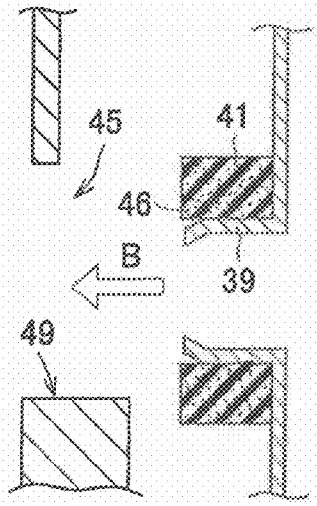
FIG. 14 is a cross-sectional view of the projection part 39, the hole part 45, and the sealing member 41.

FIG. 14 is a cross-sectional view of the projection part 39, the hole part 45, and the sealing member 41.

As shown in FIG. 14, an inclined surface 46 is formed in a portion of the periphery of the projection part 39 along the insertion direction B, that is, the front end of the projection part 39, thus resulting in a size-reduction along the insertion direction B. Alternatively, the inclined surface 46 may be formed along the circumference of the front end of the projection part 39 to form an annular shape.

Figure 15:
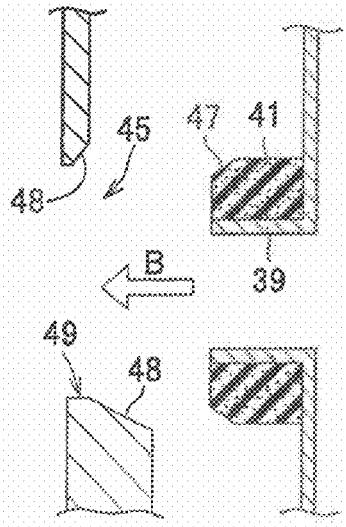
FIG. 15 is a cross-sectional view illustrating a modification to FIG. 14.

FIG. 15 is a cross-sectional view illustrating a modification to FIG. 14.

As shown in FIG. 15, there is not the inclined surface 46 on the projection part 39, but an inclined surface 47 is formed on a part of the periphery of the sealing member 41 along the insertion direction B, resulting in a size-reduction along the insertion direction B, or, the inclined surface 47 may be formed along the circumference of the sealing member 41 to form an annular shape.

Alternatively, an inclined surface 48 may also be formed on a part of the inner surface of the hole part 45 (including the contacting part 49) to result in a size-reduction along the insertion direction B, or, the inclined surface 48 may be formed along the circumference of the inner surface of the hole part 45 to form an annular shape.

In addition, instead of a taper shape, the cross sections of the inclined surfaces 46, 47, and 48 may be a curved shape or other shapes.

Figure 16:
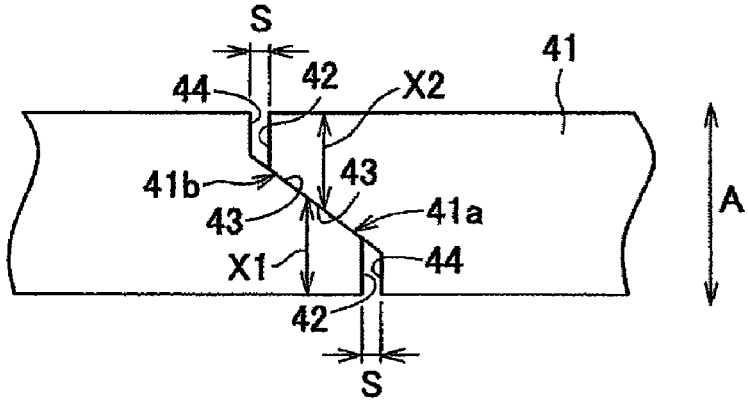
FIG. 16 is an enlarged plan view illustrating a principal portion of the sealing member 41 according to another embodiment.

FIG. 16 is an enlarged plan view illustrating a principal portion of the sealing member 41 according to another embodiment.

FIG. 16 shows the end surfaces 41*a*, 41*b* of the sealing member 41, which face each other, when the sealing member 41 is wound on the outer surface of the projection part 39 (not illustrated in FIG. 16).

In the embodiment shown in FIG. 16, the connection surfaces 43 of the two ends 41*a*, 41*b* are inclined relative to the thickness direction A, and the widths X1 and X2 of the sealing member 41 gradually become small from the side of the concave surface 44 to the side of the convex surfaces 42. In the embodiment shown in FIG. 16, similar to the embodiment shown in FIG. 8, the two connection surfaces 43 can be brought into contact, and there are intervals S between the concave surface 44 and the convex surface 42. However, the intervals S in FIG. 16 are shorter than the intervals S in FIG. 8 in the thickness direction A.

Note that the concave surface 44 and the convex surfaces 42 may be shaped to be inclined relative to the thickness direction A; instead of planes, the concave surface 44, the connection surfaces 43, and the convex surfaces 42 may also be curved surfaces.

Below, a method of assembling the developing unit 100 and the left-side supporting member 102 is described.

As shown in FIG. 9, the left-side supporting member 102 is arranged to face the left side surface of the developing unit 100, and the left side surface of the developing unit 100 and the left-side supporting member 102 are brought close to each other. Along with this, the driving force transmitting axle 32 approaches the insertion hole 29*a* of the stirring screw 29, and also the conveyance opening 38 approaches the conveyance screw 28.

As shown in FIG. 11, since the size Y1 of the gap between the driving force transmitting axle 32 and the stirring screw 29 (precisely, the insertion hole 29*a* of the stirring screw 29) is less than the size Y2 of the gap between the conveyance opening 38 and the conveyance screw 28, the driving force transmitting axle 32 is first inserted into the insertion hole 29*a* of the stirring screw 29. Next, the conveyance screw 28 is inserted into the conveyance opening 38. It should be noted that when the relationship between the size Y1 and the size Y2 is reversed, the conveyance screw 28 is first inserted into the conveyance opening 38.

Next, the developing unit 100 and the left-side supporting member 102 are brought closer to each other, and the projection part 39 is inserted into the hole part 45. At this stage, the sealing member 41 wound on the projection part 39 is pressured by the inner surface of the hole part 45 and is compressed.

When the developing unit 100 and the left-side supporting member 102 are brought to a certain position sufficiently close to each other, the boss 51L on the left side surface of the developing unit 100 is inserted into the slide engagement portion 52L, and the left end 5L of the rotating axle of the developing roller 55 is inserted into the bearing 53L (refer to FIG. 2 and FIG. 4). Then, the developing unit 100 and the left-side supporting member 102 are attached to each other by not illustrated engaging projections and depressions formed on the developing unit 100 and the left-side supporting member 102.

After the developing unit 100 and the left-side supporting member 102 are assembled, as shown in FIG. 4, the driving force transmitting axle 32 and the stirring screw 29 are engaged with each other and are connected. Further, the end of the conveyance screw 28 passes through the conveyance opening 38, and is accommodated in the toner receiving part 34 of the left-side supporting member 102.

After assembling of the developing unit 100 and the left-side supporting member 102 is finished, the outer surface of the sealing member 41 is in close contact with the inner surface of the hole part 45 over the circumference.

Figure 17:
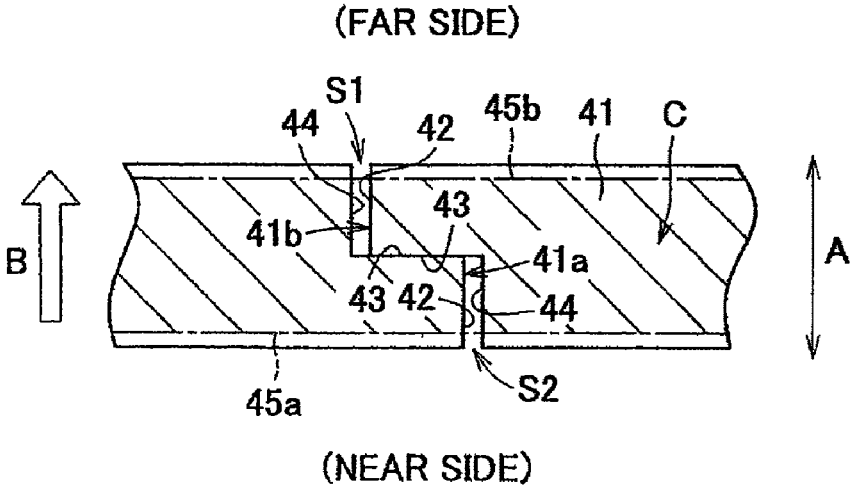
FIG. 17 is an enlarged plan view illustrating a principal portion of the sealing member 41 and the hole part 45 to show a contacting area between the hole part 45 and the sealing member 41.

FIG. 17 is an enlarged plan view illustrating a principal portion of the sealing member 41 and the hole part 45 to show a contacting area between the hole part 45 and the sealing member 41.

As shown in FIG. 17, the outer surface of the sealing member 41 near the end surfaces 41*a*, 41*b*, which are brought to face each other, is in close contact with the contacting part 49 of the hole part 45 in the hatched area.

Since the outer surface of the sealing member 41 near the end surfaces 41*a*, 41*b*, in which intervals S1, S2 may exist, is in close contact with the contacting part 49 of the hole part 45 in the thickness direction, it is possible to prevent leakage of toner from the intervals S1, S2. Further, since the connecting surfaces 43 of the sealing member 41 are in close contact with each other, it is possible to reliably seal the outer surface of the projection part 39 and the inner surface of the hole part 45.

In FIG. 17, it is assumed that an arrow B indicates the insertion direction of the projection part 39 relative to the hole part 45, and the front side along the insertion direction B is defined as a "far side", and the back side in the insertion direction B is defined as a "near side". That is, in FIG. 17, the upper side is the far side, and the lower side is the near side. As shown in FIG. 17, there are intervals S1, S2 between the convex surfaces 42 and the concave surfaces 44, which face each other. In this case, an end 45*a* on the near side of an contacting area C (a close-contact area) between the outer surface of the projection part 39 and the inner surface of the sealing member 41 (the contacting part 49) is arranged to be close to the near side compared to the far side interval S1. On the other hand, an end 45*b* on the far side of the contacting area C is arranged to be close to the far side compared to the near side interval S2. With such a structure, it is possible to prevent leakage of toner from the intervals S1, S2 to the outside.

In the current embodiment, since the waste toner section 25 for re-collecting the waste toner is on the far side of the sealing member 41, the waste toner may possibly enter into the interval S1 on the far side. However, since the interval S1 on the far side does not open to the near side (outside), the waste toner does not leak from the interval S1 to outside (the near side). In addition, since the interval S2 on the near side does not open to the near side (inside), the waste toner does not leak from the interval S2 to the outside.

Figure 18:
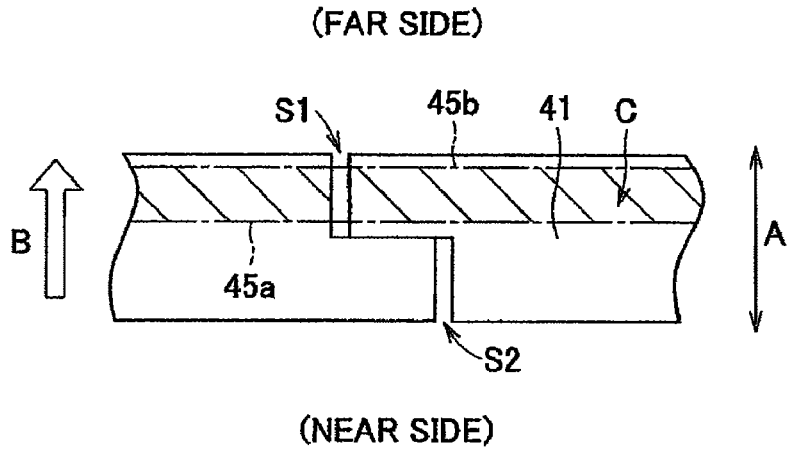
FIG. 18A is an enlarged plan view illustrating a comparison example of the contacting area between the hole part 45 and the sealing member 41.
FIG. 18B is an enlarged plan view illustrating another comparison example of the contacting area between the hole part 45 and the sealing member 41.
Figure 18:
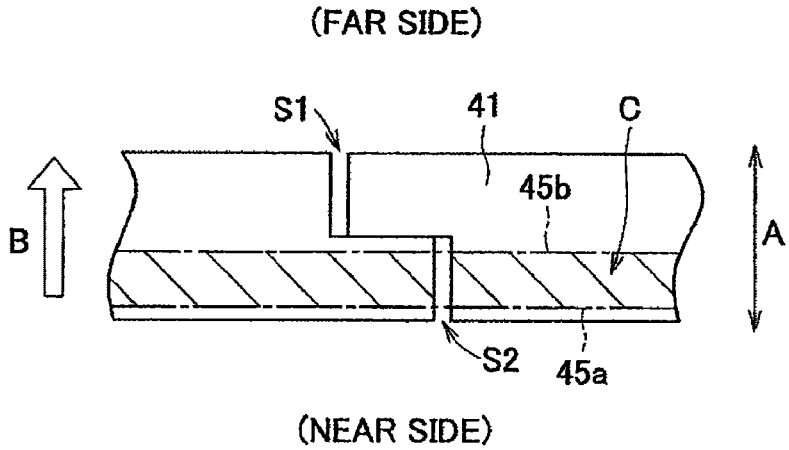

FIG. 18A is an enlarged plan view illustrating a comparison example of the contacting area between the hole part 45 and the sealing member 41.

FIG. 18B is an enlarged plan view illustrating another comparison example of the contacting area between the hole part 45 and the sealing member 41.

Different from the conditions shown in FIG. 17, when the contacting area C is narrow in the thickness direction A, conditions of the contacting area C as shown in FIG. 18A and FIG. 18B may occur.

In FIG. 18A, the end 45*a* on the near side of the contacting area C is not at a position close to the near side compared to the far side interval S1, but the end 45*a* intersects the interval S1. In this case, since the interval S1 opens to both the near side and the far side, the waste toner may pass through the interval S1 and leak to the outside.

In FIG. 18B, the end 45*b* on the far side of the contacting area C is not at a position close to the far side compared to the near side interval S2, but the end 45*a* intersects the interval S2. In this case, since the interval S2 opens to both the near side and the far side, the waste toner may pass through the interval S2 and leak to the outside.

Figure 19:
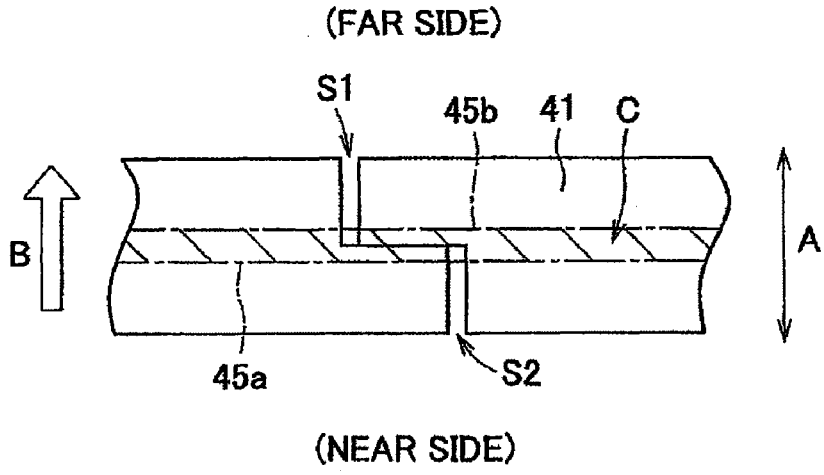
FIG. 19 is an enlarged plan view illustrating another embodiment of the contacting area between the hole part 45 and the sealing member 41.

FIG. 19 is an enlarged plan view illustrating another embodiment of the contacting area between the hole part 45 and the sealing member 41.

Even when the width of the contacting area C in the thickness direction A is not as large as that shown in FIG. 17, if the contacting area C is arranged as that shown in FIG. 19, it is possible to prevent leakage of the waste toner. That is, it is sufficient that the end 45*a* on the near side of the contacting area C be arranged to be close to the near side compared to the far side interval S1, and the end 45*b* on the far side of the contacting area C be arranged to be close to the far side compared to the near side interval S2. However, in this case, a mechanism for positioning in the insertion direction B is preferable so that the outer surface of the sealing member 41 and the inner surface of the hole part 45 are in contact at a position within the contacting area C.

Figure 20:
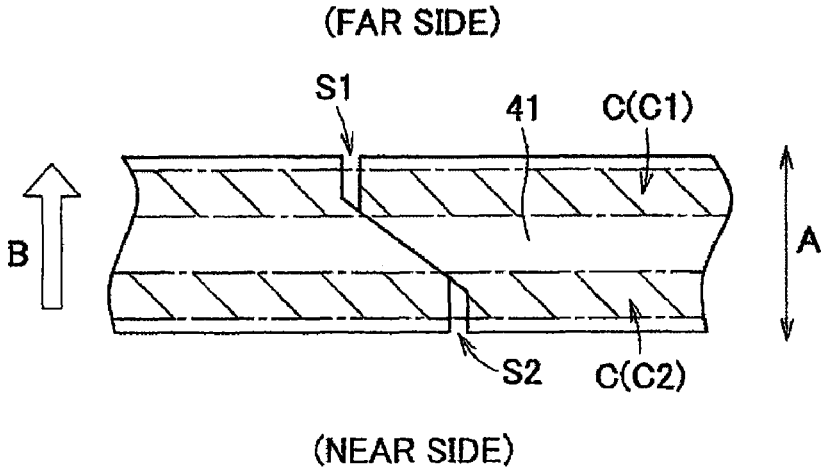
FIG. 20 is an enlarged plan view illustrating a principal portion of the sealing member 41 and the hole part 45 to show a contacting area between the hole part 45 and the sealing member 41 when the sealing member 41 shown in FIG. 16 is adopted.

FIG. 20 is an enlarged plan view illustrating a principal portion of the sealing member 41 and the hole part 45 to show a contacting area between the hole part 45 and the sealing member 41 when the sealing member 41 shown in FIG. 16 is adopted.

In FIG. 16, the distance between the two intervals S1, S2 in the thickness direction A is greater than the distance between the two intervals S1, S2 in the thickness direction A in FIG. 19.

In this case, as shown in FIG. 20, although the contacting area C is narrow in the thickness direction A, if the contacting area C is moved from a position Cl near the far side to a position C2 near the near side, it is also possible to prevent leakage of the waste toner. That is, even when the contacting area C is narrow in the thickness direction A, if the sealing member 41 as shown in FIG. 20 is adopted, it is possible to increase the tolerable range of positioning the sealing member 41 and the hole part 45 in the insertion direction B.

When assembling the developing unit 100 and the right-side supporting member 103, as shown in FIG. 2, the developing unit 100 and the right-side supporting member 103 are arranged to face each other, then the developing unit 100 and the right-side supporting member 103 are brought to approach each other, the boss 51R on the right side surface of the developing unit 100 is inserted into the slide engagement portion 52R, and the right end SR of the rotating axle of the developing roller 55 is inserted into a bearing (not illustrated). Then, the developing unit 100 and the right-side supporting member 103 are attached to each other by not illustrated engaging projections and depressions formed on the developing unit 100 and the left-side supporting member 102.

When assembling the image carrying unit 101 and the left-side supporting member 102, from the conditions shown in FIG. 2, the image carrying unit 101 and the left-side supporting member 102 are brought to approach each other to engage each other. In this case, the left end of a rotational axle of the image carrier 2 is inserted into the bearing 50L of the left-side supporting member 102. In addition, a connection hole 57, which is in communication with the left end of the toner receiving section 30 of the image carrying unit 101 (refer to FIG. 3), is connected to a connection hole 58, which is in communication with a lower end of the annular groove 31 of the left-side supporting member 102 (refer to FIG. 4).

When assembling the image carrying unit 101 and the right-side supporting member 103, as shown in FIG. 2, the image carrying unit 101 and the right-side supporting member 103 are arranged to face each other, then the image carrying unit 101 and the right-side supporting member 103 are brought to approach each other to engage each other. Specifically, a right end 2R of the rotational axle of the image carrier 2 is inserted into the bearing 5OR of the right-side supporting member 103.

As described above, when the developing unit 100 is attached to the left-side supporting member 102 and the right-side supporting member 103, the developing unit 100 is allowed to move slightly in the vertical direction relative to the left-side supporting member 102 and the right-side supporting member 103. When the developing unit 100 is attached to the left-side supporting member 102, since the projection part 39 is connected with the hole part 45 with the sealing member 41 formed from an elastic material in between, the projection part 39 is able to move relatively in a direction perpendicular to the direction in which the projection part 39 is inserted into the hole part 45. Therefore, as shown in FIG. 4, since the developing roller 55 is brought to approach and come into contact with the image carrier 2 due to the elastic potential energy of the spring 54L, it is possible to allow the developing unit 100 to follow the housing 100*a*. It is preferable that the sealing member 41 be formed of materials having flexibility sufficient for the developing unit 100 to follow the housing 100*a* due to the elastic potential energy of the spring 54L. For example, the sealing member 41 may be formed of foam PUR (polyurethane), which is superior in flexibility. Further, the flexibility of the sealing member 41 can be adjusted by changing the foam rate.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

For example, in the above embodiments, it is described that the left-side supporting member 102 serves as the first housing, the right-side supporting member 103 serves as the second housing, and the first powder conveyance path of the first housing and the second powder conveyance path of the second housing are joined by the projection portion, the hole portion, and the sealing member. However, the present invention is not limited to this. For example, the first housing and the second housing can be exchanged, the projection portion can be formed on side surfaces of the developing unit 100, the hole portion can be formed on the left-side supporting member 102. Further, the sealing member can be arranged on the inner surface of the hole portion. Furthermore, the left-side supporting member 102 may be the first housing, and the image carrying unit 101 may be the second housing.

In the above embodiments, it is described that the processing unit includes the image carrier 2, the cleaner 3, the charger 4, the developer 5, and the toner container 6, which are integrated together. However, the toner container 6 may be integrated with one or more of the image carrier 2, the cleaner 3, the charger 4, and the developer 5. In addition, one of the cleaner 3, the charger 4, and the developer 5 may be integrated with the image carrier 2 and the toner container 6. Furthermore, the processing unit may include components in addition to the image carrier 2, the cleaner 3, the charger 4, the developer 5, and the toner container 6.

In addition, the projection portion and the hole portion structure of the present invention can be applied to a powder conveyance device which is independent from the image carrier 2, the cleaner 3, the charger 4, the developer 5, and the toner container 6, and includes powder conveyance paths. The powder conveyance device may be used in devices other than the above processing unit and the image forming device, and can be used for conveying powder other than toner.

This patent application is based on Japanese Priority Patent Application No. 2007-122702 filed on May 7, 2007, the entire contents of which are hereby incorporated by reference.

What is claimed is:

1. A powder conveyance device, comprising:

a first housing including a first powder conveyance path; and a second housing including a second powder conveyance path, the first housing and the second housing being detachably attached to each other;

wherein a projection portion is provided in the first housing, the projection portion having adjacent holes in communication with the first powder conveyance path, the projection portion having a partition wall dividing said holes, a hole portion is provided in the second housing, the hole portion being in communication with the second powder conveyance path, when attaching the first housing to the second housing, the projection portion is inserted into the hole portion, and when detaching the first housing from the second housing, the projection portion is drawn out of the hole portion, further comprising:

a plurality of combinations of an insertion axle and an insertion hole the insertion axle being insertable in the insertion hole when the projection portion is inserted into the hole portion, wherein in each of the combinations, the insertion axle is provided on an inner side of one of the hole of the projection portion and the hole portion, and the insertion hole is provided on an inner side of the other one of the hole of the projection portion and the hole portion.

2. The powder conveyance device as claimed in claim 1, wherein a sealing member is provided on an outer surface of the projection portion.

3. The powder conveyance device as claimed in claim 2, wherein the sealing member is provided on the outer surface of the projection portion with an adhesive.

4. The powder conveyance device as claimed in claim 2, wherein a thickness of the sealing member is greater than a gap between the outer surface of the projection portion and an inner surface of the hole portion.

5. The powder conveyance device as claimed in claim 4, wherein a shape of an outer periphery of the projection portion is similar to a shape of an inner periphery of the hole portion.

6. The powder conveyance device as claimed in claim 4, wherein the sealing member is formed of an elastic material.

7. The powder conveyance device as claimed in claim 2, wherein an inclined surface is formed on one or more of the outer surface of the projection portion, an outer surface of the sealing member, and an inner surface of the hole portion;

the inclined surface is inclined such that a size of the inclined surface decreases in an insertion direction in which the projection portion is inserted into the hole portion.

8. The powder conveyance device as claimed in claim 2, wherein the sealing member is elongated, and is wound on the outer surface of the projection portion.

9. The powder conveyance device as claimed in claim 8, wherein when the sealing member is wound on the outer surface of the projection portion, each of two opposite end surfaces of the sealing member includes:

a convex surface portion that projects to the other end surface;

a concave surface portion that faces a convex surface portion of the other end surface; and a connecting surface portion that connects the convex surface portion and the concave surface portion, and intersects a thickness direction of the sealing member, wherein the connecting surface portions of the two end surfaces are able to be brought into contact with each other.

10. The powder conveyance device as claimed in claim 9, wherein a length from the convex surface portion of one of the end surfaces of the sealing member to the concave surface portion of the other one of the end surfaces of the sealing member is shorter than a circumferential length of the projection portion.

11. The powder conveyance device as claimed in claim 8, wherein a contacting portion is provided on the inner surface of the hole portion such that the contacting portion is in contact with a portion of the outer surface of the sealing member near the two opposite end surfaces of the sealing member.

12. The powder conveyance device as claimed in claim 1, wherein when the projection portion is arranged to face the hole portion, intervals between the insertion axles and the corresponding insertion holes are different.

13. The powder conveyance device as claimed in claim 1, wherein one or more of the insertion axles are conveyance screws for powder conveyance, and the insertion holes corresponding to the one or more of the insertion axles are conveyance openings for powder conveyance.

14. The powder conveyance device as claimed in claim 1, wherein the insertion axles and the insertion holes are connected by coupling.

15. The powder conveyance device as claimed in claim 1, wherein an interference portion is provided that interferes with one of the insertion axles when the one of the insertion axles is inserted into one of the insertion holes other than the insertion hole corresponding to the one of the insertion axles.

16. The powder conveyance device as claimed in claim 2, wherein the first housing and the second housing are attached so that the first housing and the second housing are able to be displaced relative to each other in a direction perpendicular to a direction of attaching the first housing and the second housing, and the sealing member is formed of a flexible material.

* * * * *